US006966794B2

(12) United States Patent
Aoyama et al.

(10) Patent No.: US 6,966,794 B2
(45) Date of Patent: Nov. 22, 2005

(54) CONNECTOR SUPPORTING STRUCTURE AND A SQUEEZED AMOUNT CALCULATING METHOD

(75) Inventors: Masahiko Aoyama, Yokkaichi (JP); Hiroshi Nakano, Yokkaichi (JP); Atsushi Nishida, Toyota (JP); Masato Minakata, Toyota (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 10/858,097

(22) Filed: Jun. 1, 2004

(65) Prior Publication Data

US 2004/0242059 A1 Dec. 2, 2004

(30) Foreign Application Priority Data

May 30, 2003 (JP) ..... 2003-155901
May 30, 2003 (JP) ..... 2003-155908

(51) Int. Cl.[7] ..... H01R 13/73

(52) U.S. Cl. ..... 439/545

(58) Field of Search ..... 439/545–549, 439/560, 562, 563, 564, 570

(56) References Cited

U.S. PATENT DOCUMENTS 5,127,852 A * 7/1992 Cravens et al. ..... 439/545

FOREIGN PATENT DOCUMENTS

JP 11-345653 12/1999

* cited by examiner

*Primary Examiner*—Ross Gushi
(74) *Attorney, Agent, or Firm*—Gerald E. Hespos; Anthony J. Casella

(57) ABSTRACT

Supporting pieces (42) on side surfaces of a waiting-side connector (20) are insertable into supporting grooves (15) of a casing (10). Contact projections (47F, 47R) are on one outer wall surface (46) of each supporting piece near the upper end and bottom ends. A squeezable projection (55) is on an outer wall surface (44) opposite from the outer wall surface (46) where the contact projections (47) are provided. The squeezable projection (55) has a substantially triangular cross section and contacts a wall surface (13A) of the supporting groove (15) as insertion of the supporting piece (42) into the supporting groove (15) progresses. A tip of the squeezable projection (55) is squeezed at a final stage of the insertion to engage the supporting piece (42) with the supporting groove (15). Accordingly, the waiting-side connector (20) is supported in the casing (10) without shaking.

9 Claims, 16 Drawing Sheets

Corr. Characteristic of Friction Coefficient and Reaction Force

Corr. Characteristic of Squeezed Height and Reaction Force

Corr. Characteristic of Squashed Height and Inserting Force

CONNECTOR SUPPORTING STRUCTURE AND A SQUEEZED AMOUNT CALCULATING METHOD

BACKGROUND OF THE INVENTION

1. Field of the Invention

The invention relates to a connector supporting or temporary holding construction and to a squeezed amount calculating method when a resin-made fixable member is temporarily held on a metal fixing member by squeezing a part of the fixable member, and a squeezable supporting construction using such a method.

2. Description of the Related Art

Japanese Unexamined Patent Publication No. H11-345653 and FIG. 8 herein show a supporting construction that takes advantage of the engagement of recesses and projections for mounting a connector with respect to a fixing member, such as an electrical connection box in an automotive vehicle. With reference to FIG. 8, the supporting construction has a fixing member 1 with two facing recesses 2 and a projection 3. A connector 5 has two projections 6 provided on opposite left and right surfaces of the connector 5. The connector 5 is assembled with the fixing member 1 by inserting the projections 6 of the connector 5 into the recesses 2 of the fixing member 1 from below in FIG. 8. The connector 5 also has a step 7 engageable with the projection 3, so that the connector 5 can be locked to the fixing member 1.

In the above construction, clearances of a certain degree are set between the recesses 2 and the projections 6 to assemble the connector 5 with the fixing member 1 smoothly. However, the mounted connector 5 shakes by due to these clearances and escapes as much as it shakes upon being connected with a mating connector. As a result, the two connectors cannot be connected efficiently.

The present invention was developed in view of the above problem and an object thereof is to provide a connector supporting construction having a small degree of shaking.

SUMMARY OF THE INVENTION

The invention relates to a supporting or holding construction for at least temporarily supporting or holding a waiting-side connector with respect to a fixing member. The waiting-side connector is connectable with a mating connector. The supporting construction has at least one supporting groove in one of the fixing member and the waiting-side connector. At least one support is on the other of the fixing member and the waiting-side connector, and is engageable with the supporting groove for supporting the waiting-side connector with respect to the fixing member. At least one engagement projection is provided on an outer wall surface of the support and/or an inner wall surface of the supporting groove. The engagement projection is spaced from the other wall surface at an initial stage of inserting supporting portion into the supporting groove, but substantially no clearance exists at a final stage of the insertion.

Accordingly, the waiting-side connector can be fixed to the fixing member so as not to shake since the supporting portion and the supporting groove can be engaged closely while leaving no clearance. Accordingly, a mating connector can be assembled easily with the waiting-side connector. Further, the engagement projection is engaged substantially at the final stage of the insertion. Thus, an operator can easily perform the assembling operation with force and, hence, assembling operability is good.

The engagement projection preferably comprises a squeezable projection to be squeezed between the support and the supporting groove. The squeezable projection is squeezed at the final stage of the insertion. Thus, an operator can easily perform the assembling operation with force and, hence, assembling operability is good.

The spacing between the facing wall surfaces of the supporting groove and the support preferably is narrowed gradually as the support is inserted into the supporting groove. Additionally, the engagement projection, preferably the squeezable projection, has a cross section that gradually narrows toward the outer wall surface of the support or the inner wall surface of the supporting groove. Accordingly, the engagement projection is engaged from the leading end thereof and an engagement amount gradually increases as the waiting-side connector is assembled with the fixing member. Thus, the operator can perform the assembling operation more easily with force as compared to a case where the engagement amount is the same from the start to the end of the engagement.

Preferably, the supporting groove is in the fixing member and the support on the waiting-side connector. Projections, including the engagement projections, for contacting the inner wall surfaces of the supporting groove are at least at three positions of the front and/or rear wall surfaces of the support. Accordingly, the projections, including the engagement projection, contact the supporting groove at least at three points when assembly is complete. As a result, the support is supported at three points. The entire support can be supported effectively if the projections are arranged in a well-balanced manner (e.g. at the substantially opposite ends and in an intermediate portion) with respect to the support. Further, main portions (portion excluding the projections) of the support are spaced from the supporting groove. Thus, warping of the main portion has no influence on the support.

A projecting amount along a transverse direction of the supporting piece from a side surface preferably is substantially constant at a rear end of the supporting piece with respect to inserting direction, but gradually decreases from an intermediate position to a leading end of the supporting piece.

The spacing of the supporting groove may be narrowed gradually or in steps in the mounting direction.

The squeezable projection preferably has a substantially triangular cross section tapered toward the inner wall of the groove to form an angle of between about 50° and 70°, preferably of about 60°. A squeezed height of a front end of the squeezable projection with respect to the inserting direction is in a range of about 0.3 mm to about 0.35 mm.

The invention also relates to a squeezable supporting or holding construction for at least temporarily supporting or holding a resin fixable member on a metal fixing member by bringing a leading-end of at least one squeezable projection on at least one supporting piece into contact with an inner wall of a groove at an angle of less than about 3° to an inserting direction. The squeezable supporting construction is squeezed in the process of inserting the supporting piece into the groove. The squeezable projection preferably has a substantially triangular cross section tapered toward the inner wall of the groove at an angle of between about 50° and about 70°, and a squeezed height of a front end of the squeezable projection with respect to the inserting direction lies preferably is in a range of about 0.3 mm to about 0.35 mm. The intensity of the inserting force is about 30 to about 35 (N) if the squeezed height is about 0.35 mm. Thus, there is no likelihood of reducing the assembling operability of an operator. Further, in the case of the squeezed height of about 0.3 mm, the pressing force P is about 15 to 20 (N) and a sufficient reaction force (holding force) in the groove portion can be obtained.

The invention also relates to a method for calculating a squeezed amount of a squeezable projection upon temporarily holding a resin fixable member on a metal fixing member by bringing a leading-end of the squeezable projection on a supporting piece into contact with an inner wall of a groove at an angle θ° to an inserting direction to squeeze the squeezable projection. The method employs the following equations:

$$F+P\times\sin\theta=\mu\times N\times\cos\theta+N\times\sin\theta \quad (1)$$

$$N\times\cos\theta=\mu\times N\times\sin\theta+P\times\cos\theta \quad (2)$$

$$F=(\mu/(\cos\theta-\sin\theta))\times P \quad (3).$$

In these equations, F denotes an inserting force at the time of inserting the supporting piece into the groove, P denotes a reaction force acting from the squeezable projection to the inner wall of the groove on a squeezed surface of the squeezable projection squeezed by the inner wall, and N denotes a vertical resistance of the inner wall of the groove on the squeezed surface. The method comprises a step of calculating equation (3) defining a correlation of the inserting force F and the reaction force P in accordance with equation (1) defining the vertical balancing of the forces F, P, N and equation (2) defining the horizontal balancing thereof with the use of a simulated reaction-force measurement model comprised of a metallic member, preferably made of the same material as the fixing member, and a resin member, preferably made of the same material as the fixable member. The method then comprises conducting a squeezing test for squeezing the resin member by pressing the resin member against the metallic member. The method continues by obtaining a correlation characteristic of the squeezed amount and the reaction force based on the obtained test data, and calculating a correlation characteristic of the squeezed amount and the inserting force based on the correlation characteristic the squeezed amount and the reaction force and the equation (3). The method proceeds by calculating a squeezed amount A corresponding to a lower limit value of the reaction force from the correlation characteristic the squeezed amount and the reaction force, assuming the intensity of a holding force required to hold the supporting piece in the groove as the lower limit value of the reaction force. In the case of setting the inserting force F within a specified load range, the method includes calculating a squeezed amount B corresponding to an upper limit value of the inserting force F from the correlation characteristic of the squeezed amount and the inserting force and calculating a permissible range of the squeezed amount by setting these squeezable amounts A, B as the lower and upper limit values of the squeezed amount. Accordingly, it is possible to calculate a squeezed amount that enables the assembling with a suitable inserting force while ensuring a necessary holding force.

The upper limit value of the squeezed amount is set so that the inserting force of the supporting portion is in a specified load range. Thus, a suitable inserting force can be ensured and there is no reduction in assembling efficiency. Further, the lower limit value of the squeezed amount is set as to ensure a holding force necessary for the temporary holding. Thus, the fixable member can be held temporarily with higher reliability.

The invention may further comprise the method steps of using a simulated friction-coefficient measurement model comprised of a metallic member made of the same material as the fixing member and a resin member made of the same material as the fixable member, conducting tensile tests by pulling one end of the resin member on the metallic member to slide the resin member, measuring a tensile load in each tensile test by changing a mass M of the resin member to various values, and calculating a correlation characteristic of a force acting in a direction substantially normal to a moving surface of the metallic member on which the resin member is moved and a friction coefficient in accordance with the equation: $\mu$=Y/R. In this equation, Y denotes an obtained measured load and R denotes a force acting from the resin member to the metallic member in the normal direction. The method proceeds by calculating a friction coefficient $\mu$p corresponding to the intensity of the reaction force P from the correlation characteristic of the force acting in the normal direction and the friction coefficient, assuming that the reaction force P is the force R acting in the normal direction, and calculating the inserting force F by substituting the obtained friction coefficient $\mu$p and the reaction force into the equation (3).

According to the knowledge of the inventors, the friction coefficient on the squeezed surface may vary depending on the intensity of the reaction force created in the squeezable projection upon being squeezed (mainly resulting from fine unevenness of the squeezed surface). The calculated inserting force may not agree with an actual inserting force if the friction coefficient is set at a constant value. However, an error resulting from the friction coefficient can be excluded if the friction coefficient $\mu$p corresponding to each reaction force P is calculated by conducting the tensile test beforehand. Therefore, a highly reliable correlation characteristic of the squeezed amount and the inserting force can be obtained.

These and other features of the invention will become more apparent upon reading of the following detailed description and accompanying drawings. It should be understood that even though embodiments are described separately, single features may be combined to additional embodiments.

DETAILED DESCRIPTION OF THE PREFERRED EMBODIMENTS

Figure 1:
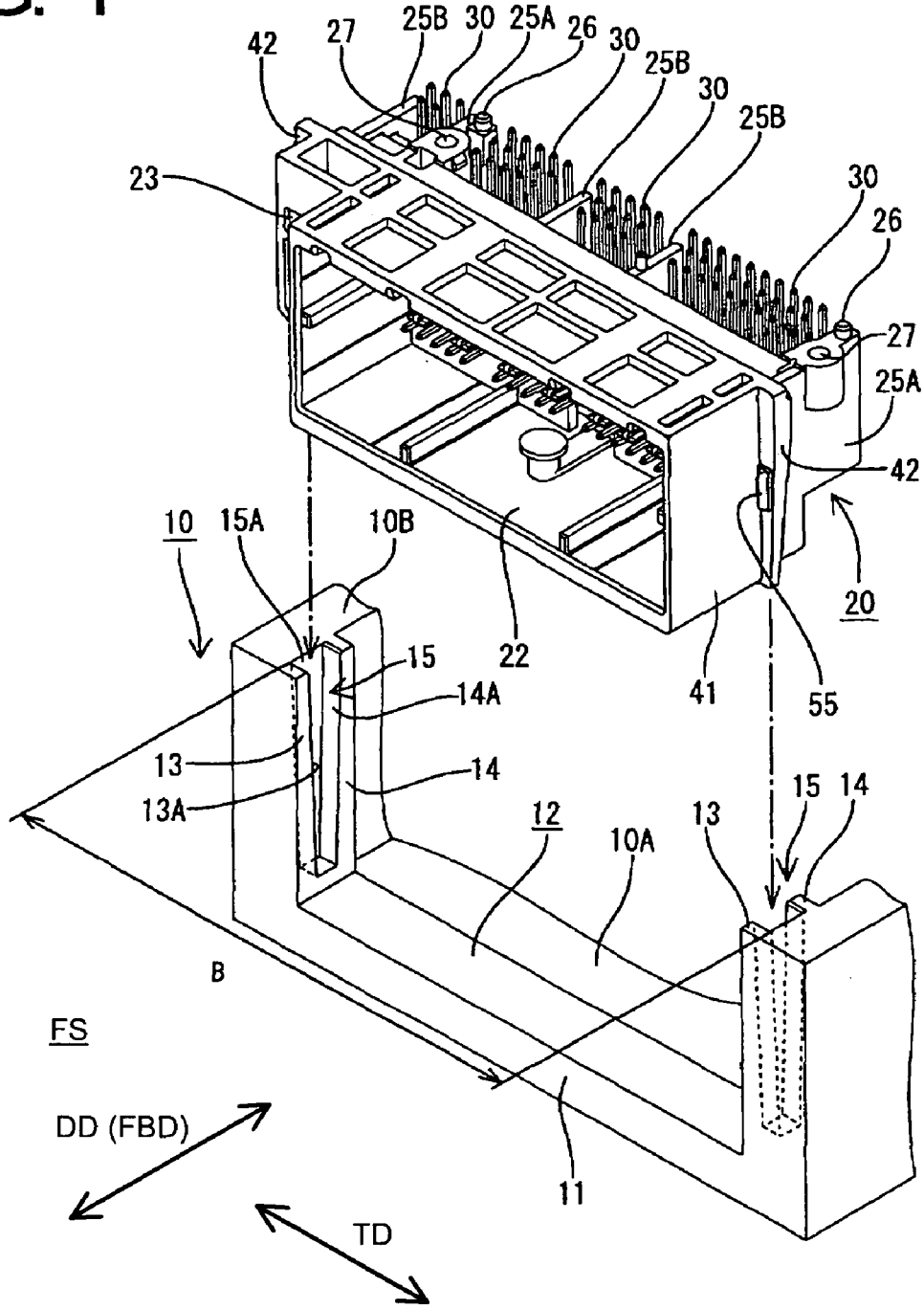
FIG. 1 is a perspective view of a waiting-side connector and a casing according to one embodiment of the invention.
Figure 2:
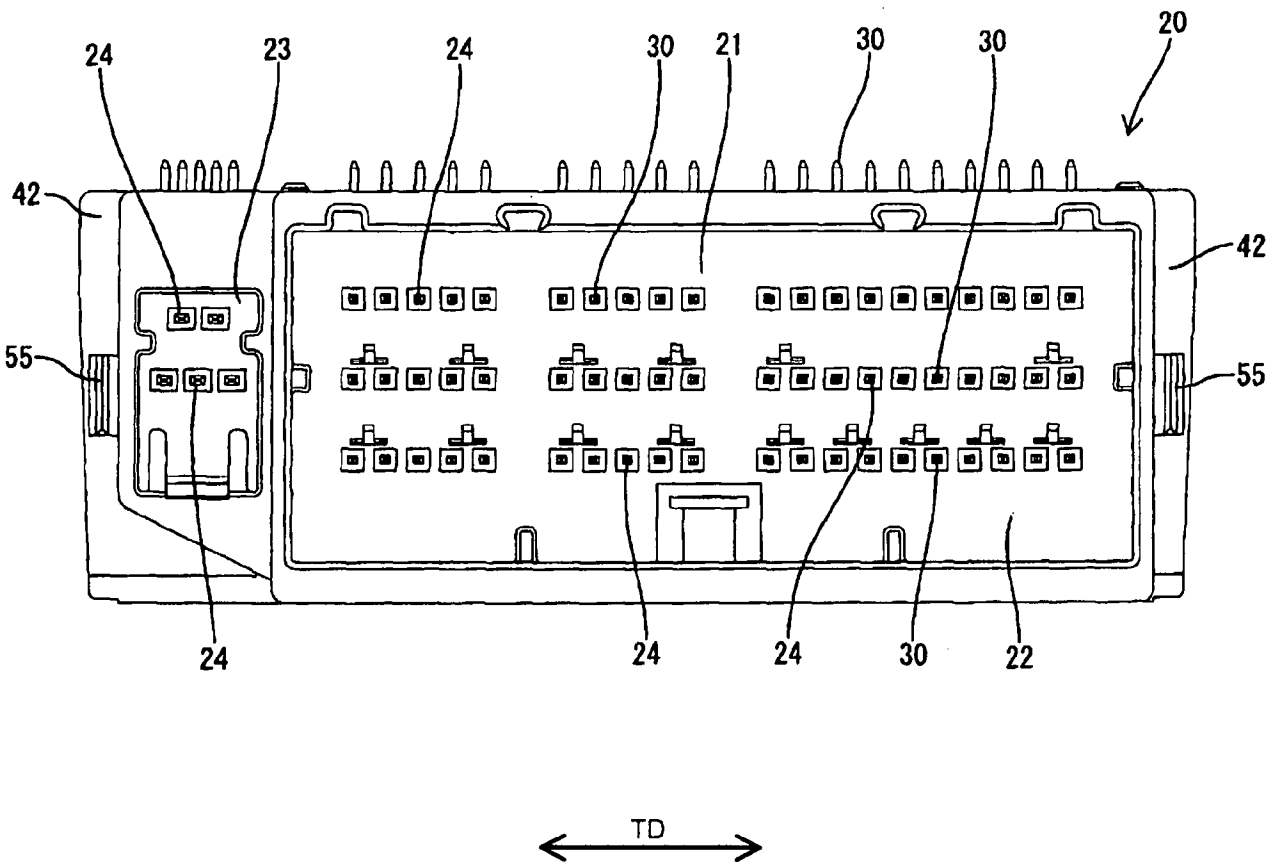
FIG. 2 is a front view of the waiting-side connector.
Figure 3:
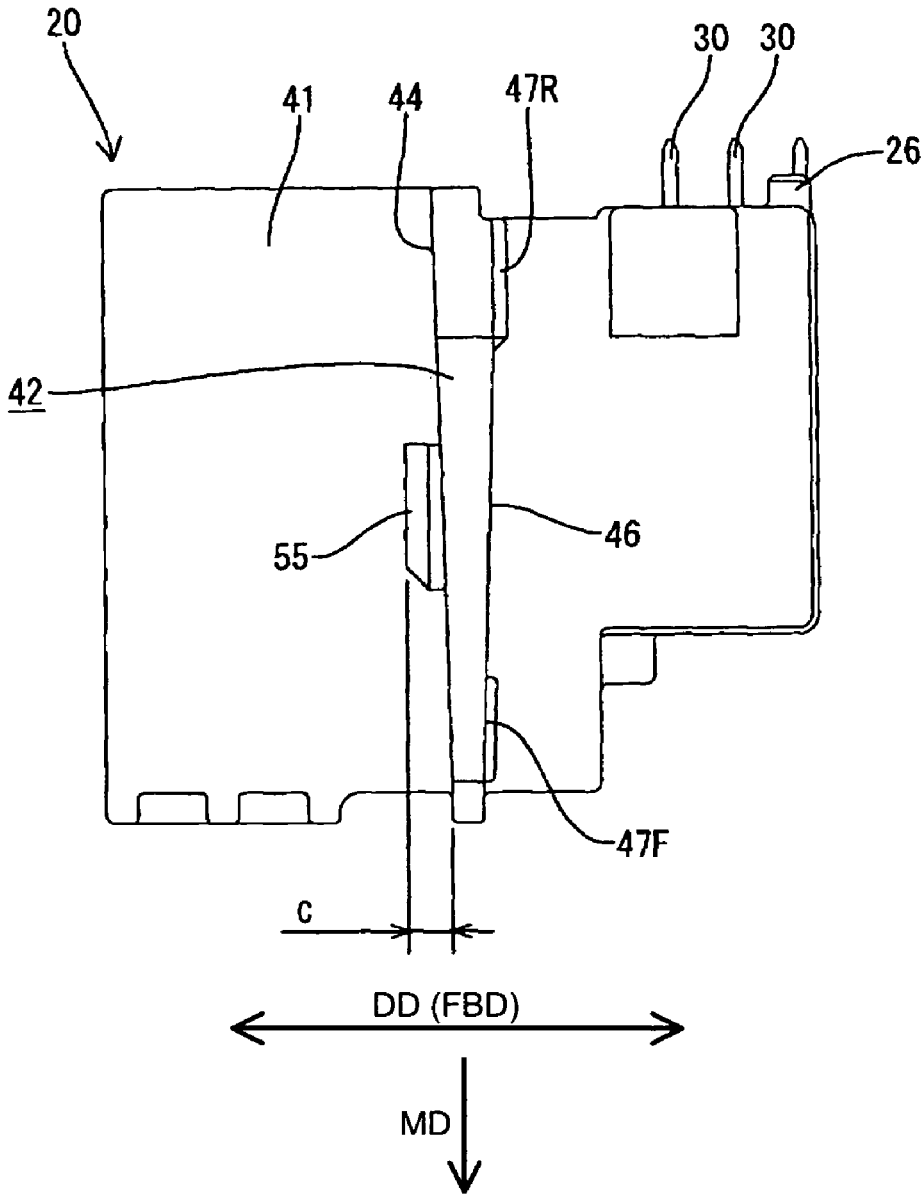
FIG. 3 is a side view of the waiting-side connector.

A hard aluminum die-cast casing is identified by the numeral 10 in FIG. 1. The casing 10 has one side surface 11 open along forward and backward directions FBD and is substantially box-shaped so that an electric circuit board (not shown) can be accommodated therein. A mounting portion 12 is open in the side surface 11 is used to mount a waiting-side connector 20. In the following description, a mating side of the waiting-side connector 20 (front side in FIG. 1) is referred to as a front side FS.

The waiting-side connector 20 is made e.g. of a synthetic resin, preferably polybutylene terephthalate, and has a back wall 21. First and second receptacles 22 and 23 are formed substantially side-by-side and project forward from the back wall 21 of the waiting-side connector 20. The first receptacle 22 is a wide substantially rectangular tube and the second receptacle 23 is a smaller substantially rectangular tube. Mating connectors (not shown) are fittable into the respective receptacles 22, 23 from the front. Terminal mount holes 24 penetrate the back wall 21 of the receptacles 22, 23 substantially along forward and backward directions. The terminal mount holes 24 are arranged at specified intervals along transverse direction TD, at upper, middle and lower stages in the first receptacle 22 and at upper and lower stages in the second receptacle 23.

Each terminal fitting 30 is made of a narrow and long conductive metallic bar and is pressed into the terminal mount hole 24 from behind to be held there. A front end of each terminal fitting 30 projects into the receptacle 22, 23 from the respective terminal mount hole 24 for electrical connection with a female terminal fitting (not shown) of the mating connector fit into the receptacle 22, 23. A portion of the terminal fitting 30 drawn out through the rear surface of the waiting-side connector 20 has its leading-end side bent at substantially a right angle (L-shape) for connection with the circuit board in the casing 10.

Terminal protecting walls 25A, 25B in the form of substantially vertical plates extend back from the rear surface of the waiting-side connector 20. The respective terminal protecting walls 25A, 25B are spaced at specified intervals with the terminal fittings 30 located between each pair of adjacent terminal projecting walls 25A, 25B. The terminal protecting walls 25A, 25B are substantially rectangular, and the upper ends thereof substantially cover upper sides of the terminal fittings 30 located between the respective terminal protecting walls 25A, 25B and the rear ends thereof project more backward than the rear ends of the terminal fittings 30. Thus, most of the terminal fittings 30 are substantially covered from left and right sides by the respective terminal protecting walls 25A, 25B, and only the leading ends thereof project more upward than the respective terminal protecting walls 25A, 25B.

Two terminal protecting walls 25A are thicker than the other terminal protecting walls 25B. A mounting projection 26 and an internally threaded hole 27 are formed at the upper end of each terminal protecting walls 25A. The mounting projections 27 fit into corresponding mount holes (not shown) formed in the electric circuit board. The electric circuit board is fastened by screws when the mounting projections 26 are fit into the mount holes, and is fixed to a rear side of the upper surface of the waiting-side connector 20. In this state, ends of the terminal fittings 30 of the waiting-side connector 20 are in through holes of the electric circuit board. The terminal fittings 30 are connected electrically with circuits on the electric circuit board by soldering, welding, ultrasonic welding, crimping and/or press-fit by resilient means in or on the circuit board and/or on the terminal fitting. Receiving portions (not shown) for supporting the electric circuit board from below project from the inner surface of the casing 10, and the casing 10 has its upper side substantially closed by an unillustrated lid with the electric circuit board accommodated therein.

Rails 13, 14 are formed on the opposite inner left and right wall surfaces of the mounting portion 12 and extend along a mounting direction MD that is substantially normal to both the forward and backward direction FBD and the transverse direction TD. The mounting direction MD is substantially vertical in FIG. 1. The rails 13, 14 are formed over the substantially entire height of the mounting portion 12 and openings are defined at the upper ends thereof. A supporting groove 15 is formed by substantially facing wall surfaces 13A, 14A of each pair of rails 13, 14. Supports 42 of the waiting-side connector 20 are inserted into the supporting grooves 15 in the mounting direction MD.

Figure 5:
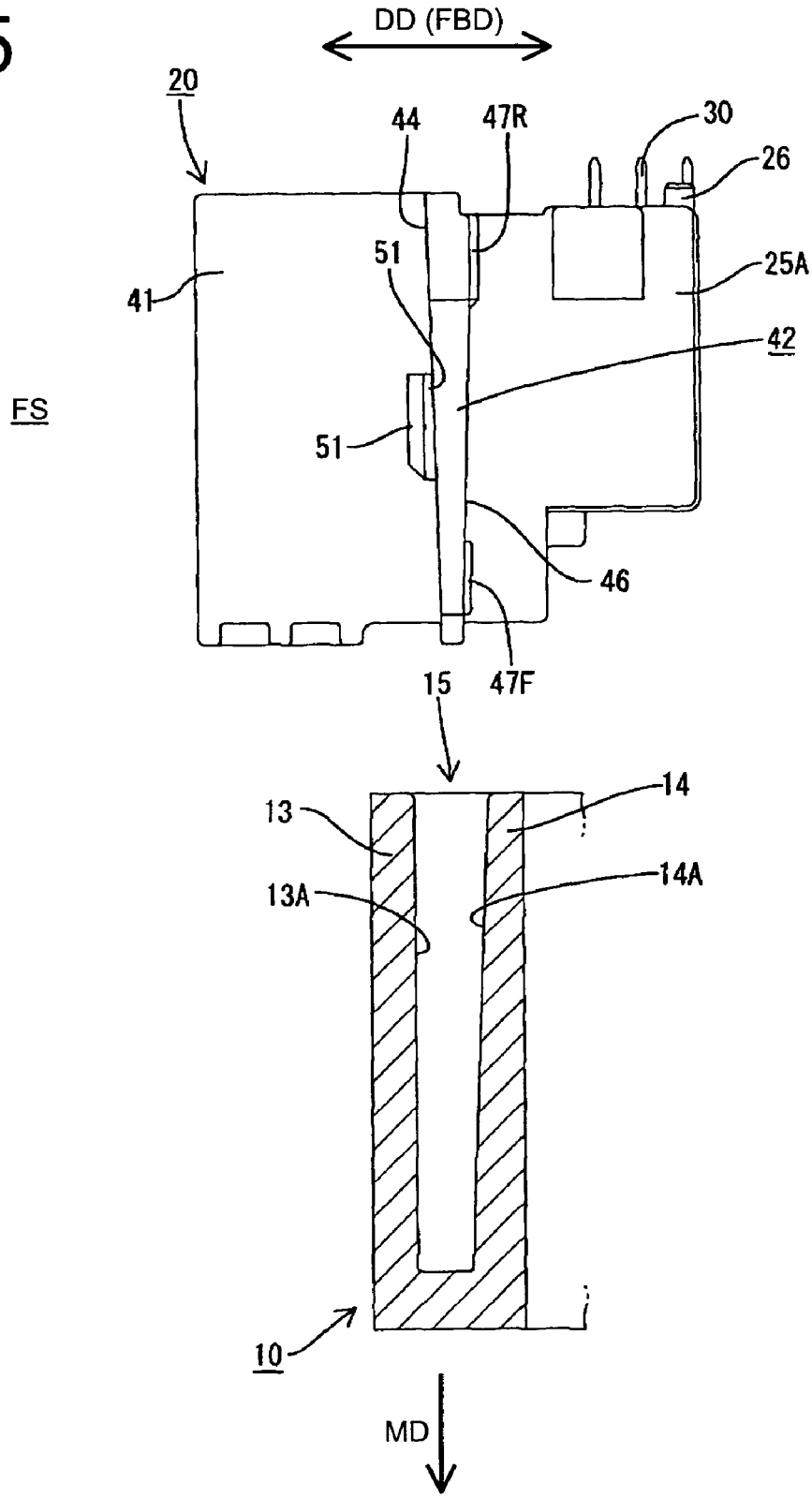
FIG. 5 is section showing a state before the waiting-side connector is mounted into the casing.

As shown in FIG. 5, the wall surfaces 13A closer to the front of the casing 10 and the wall surfaces 14A more backward than the wall surfaces 13A are inclined so that spacing along the forward and backward direction FBD between the wall surfaces 13A and 14A is gradually narrowed towards the bottom along a mounting direction MD of the waiting-side connector 20.

The supports 42 insertable into the supporting grooves 15 bulge outward in an intermediate portion of left and right surfaces 41 of the waiting-side connector 20. The supports 42 are formed vertically over more than about half and preferably over substantially the entire height of the waiting-side connector 20. Additionally, the longest spacing along the transverse direction TD between the outer edges of the supports 42 (dimension A in FIG. 4) is shorter than spacing along the transverse direction TD between back walls 15A of the supporting grooves 15 (dimension B in FIG. 1). A bulging amount of each support 42, i.e. a projecting amount along the transverse direction TD of each support 42 from the side surface 41, is substantially constant at an upper-end portion of the support 42, but gradually decreases from an intermediate position to the bottom end (leading end with respect to inserting direction MD) of the support 42. The supports 42 thus are formed to improve insertability into the supporting grooves 15.

The supports 42 have a thickness along the forward and backward direction FBD that gradually increases from the bottom end (leading end with respect to inserting direction MD into the supporting grooves 15) toward the upper end, and the opposite outer wall surfaces thereof slant substantially in conformity with the wall surfaces 13A, 14A of the rails 13, 14. Specifically, as shown in FIG. 5, a front outer wall surface 44 of each support 42 facing the wall surface 13A of the rail 13 is inclined to have substantially the same inclination as the wall surface 13A. Similarly, a rear outer wall surface 46 of each support 42 facing the wall surface 14A of the rail 14 is inclined to have substantially the same inclination as the wall surface 14A.

Clearances between the outer wall surfaces 44 of the supports 42 and the wall surfaces 13A of the rails 13 and clearances between the outer wall surfaces 46 of the supports 42 and the wall surfaces 14A of the rails 14 are sufficiently wide for the supports 42 to be inserted smoothly at an initial stage of the insertion of the supports 42 into the supporting grooves 15, but are narrowed gradually as the insertion progresses. Further, in a mounted state (FIG. 6), substantially constant clearances are defined between the front wall surfaces 44 of the supports 42 and the wall surfaces 13A of the rails 13 and between the outer wall surfaces 46 of the supports 42 and the wall surfaces 14A of the rails 14 over substantially the entire height of the supports 42.

At least one contact projection 47 and at least one squeezable projection 55 are provided on each support 42. The projections 47, 55 are inserted into the supporting grooves 15 and are held in sliding contact with the wall surfaces 13A, 14A upon assembling the waiting-side connector 20 into the casing 10. When the assembling is completed, the projections 47, 55 substantially fill the clearances between the front outer wall surfaces 44 and the wall surfaces 13A and those between the rear outer surfaces 46 and the wall surfaces 14A.

Upper and lower contact projections 47F, 47R are provided on the outer wall surface 46 of each support 42 and can substantially contact the wall surface 14A of the rail 14. The contact projections 47F, 47R have a rounded cross-section (see FIG. 4) and extend substantially along the inserting direction MD of the support 42. On the other hand, the squeezable projection 55 is provided in an intermediate portion of the outer wall surface 44 opposite from the outer wall surface 46 where the contact projections 47 are provided and, similar to the contact projections 47, extends substantially along the inserting direction MD of the support 42. The squeezable projection 55 is located substantially in the middle of the contact projections 47F, 47R with respect to the mounting direction MD of the support 42 so that the projections 55, 47 do not overlap along the inserting direction MD.

Figure 4:
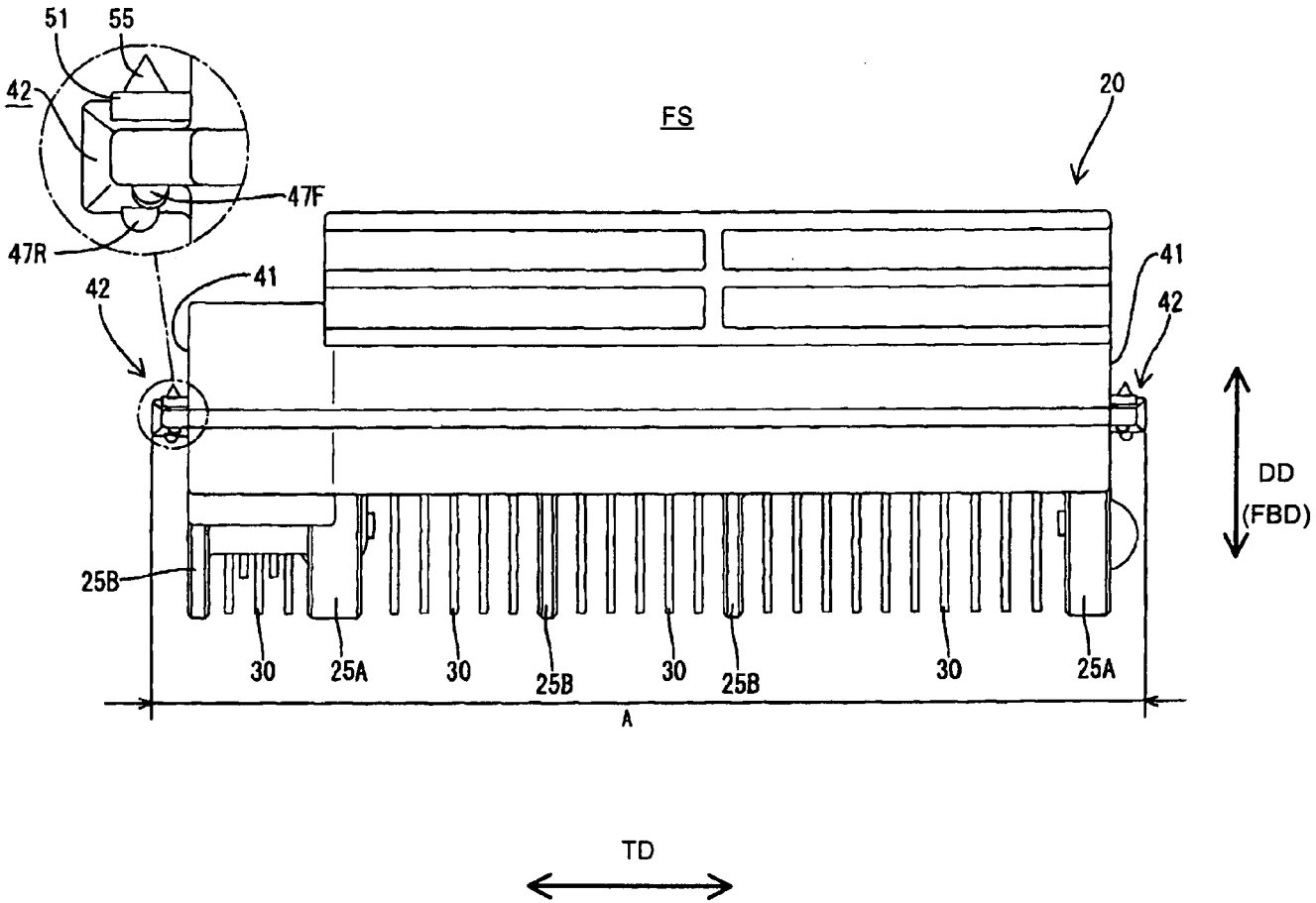
FIG. 4 is a rear view of the waiting-side connector.

Further, as shown in FIG. 4, the squeezable projection 55 is a flat plate provided on a seat 51, and a squeezable portion with a converging cross-section tapered toward the wall surface 13A is formed on the upper surface of the seat 51.

Figure 6:
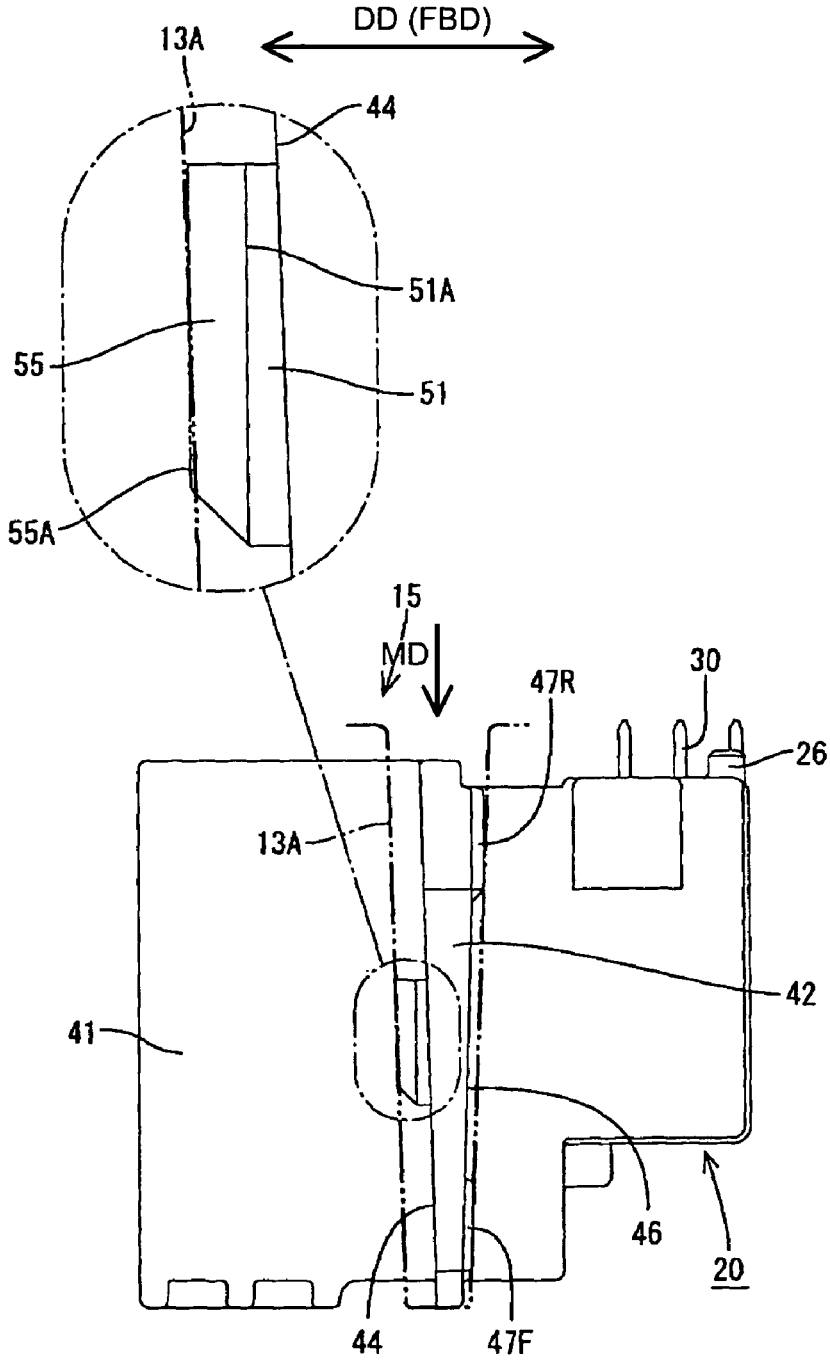
FIG. 6 is a section showing the waiting-side connector mounted in the casing.

The height or projecting distance of the squeezable projection 55 along the forward and backward direction FBD (dimension C in FIG. 6) is substantially uniform over substantially the entire length and is slightly larger than dimension D shown in FIG. 6, which is the distance between the outer wall surface 44 of the support 42 and the wall surface 13A of the rail 13 in the mounted state. Specifically, this squeezable projection 55 is spaced apart from the wall surface 13A of the rail 13 at the initial stage of the insertion of the supporting piece 42 into the supporting groove 15, and a tip thereof contacts the wall surface 13A as the insertion progresses and is substantially uniformly squeezed over substantially the entire length at a final stage. The supports 42 can be prevented from coming out upon completing the mounting operation by being pressed into the supporting grooves 15 in this way.

The supports 42 are pressed into the supporting grooves 15 at the final stage of the inserting operation, and both the squeezable projections 55 and the contact projections 47 have the tips thereof slightly squeezed. However, squeezed amounts of the contact projections 47 are smaller than those of the squeezable projections 55.

The waiting-side connector 20 is placed into the casing 10 by placing the waiting-side connector 20 right opposite the mounting portion 12 of the casing 10, and the left support 42 of the waiting-side connector 20 is aligned with the left supporting groove 15 of the casing 10 while the right support 42 is aligned with the right supporting groove 15. In this state, the waiting-side connector 20 is pushed down in the mounting direction MD and the respective supports 42 are inserted into the corresponding supporting grooves 15. Then, the waiting-side connector 20 is guided into the mounting portion 12 by the engagement of the supports 42 and the supporting grooves 15.

The facing wall surfaces 13A, 14A are spaced widely apart at the entrances of the supporting grooves 15. Thus, the supports 42 are inserted without the contact projections 47 and the squeezable projections 55 being hindered by the wall surfaces 13A, 14A of the supporting grooves 15 at the initial stage of this inserting operation. However, the spacing between the facing wall surfaces 13A, 14A becomes narrower at the back sides of the supporting grooves 15. Thus, the outer wall surfaces 44 and 46 of the supports 42 come closer to the wall surfaces 13A and 14A, respectively. The contact projections 47F, 47R substantially contact the wall surfaces 14A and the squeezable projections 55 contact with the wall surfaces 13A as the final stage of the insertion of the supports 42 approaches. The supports 42 then are pushed further in this state. As a result, the insertion progresses while the squeezable projections 55 of the supports 42 are squeezed over substantially the entire length. The bottom ends of the supports 42 then contact the bottom surfaces of the supporting grooves 15 to prevent further insertion. In this way, assembly of the waiting-side connector 20 with the casing 10 is completed.

The supports 42 closely engage the supporting grooves 15 with substantially no clearance when the assembling is completed. Thus, the squeezable projection 55 is squeezed between the support 42 and a wall surface 13A of the supporting groove 15 along the extension of the support 42 and along the mounting direction MD. Thus, the support 42 is engaged with the supporting groove 15 so that the support 42 and the waiting-side connector 20 cannot move along the forward and backward direction FBD with respect to the supporting groove 15 and the casing 10. Accordingly, the entire waiting-side connector 20 is supported in the casing 10 so as not to shake, and the mating connector can be assembled easily thereafter. Further, in the assembled state, each support 42 contacts the wall surfaces 13A, 14A of the corresponding supporting groove 15 at both contact projections 47F, 47R and at the squeezable projection 55, i.e. is supported at least at three points. In other words, the support 42 is supported stably by having upper, lower and middle portions thereof fixed to the supporting groove 15 in a well-balanced manner.

The squeezable projections 55 have a substantially pointed cross-section and are squeezed from the distal ends thereof to gradually increase the squeezed amount as the supports 42 are inserted. The cross-section of the squeezable projections 55 is in comparison to the cross-section of the contact projections 47 such that the squeezable projections 55 are more easily deformable than the contact projections 47. Thus, as compared to a case where the squeezed amounts are large from the beginning on, an operator can easily perform the assembling operation with force and, hence, assembling operability is good.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The squeezable projections 55 have a substantially triangular cross section in the foregoing embodiment. However, they may take another cross-section provided that the squeezed amounts thereof gradually increase.

Although each support 42 is provided with three projections to be supported at three points in the foregoing embodiment, the projections may be provided at more than three points, e.g. at four or five points.

The squeezable projection 47 is deformed upon complete insertion of the waiting side connector 20 into the supporting groove 15. However, the projection may be formed to bite into surfaces of the supporting groove to position the waiting-side connector with respect to the casing so as not to shake.

Even though the casing 10 has been described to be formed of a hard, preferably metallic material, the casing may be made e.g. of resin, plastic, extruded material or the like.

Upper and lower contact projections 47 are provided on the rear temporary holding surface 46 of each support 42. Both contact projections 47F, 47R have a substantially rounded cross section (see FIG. 4) and extend substantially along the mounting direction MD of the support 42. The squeezable projection 55 is in the intermediate portion of the front temporary holding surface 44 substantially opposite from the rear temporary holding surface 46 where the contact projections 47 are provided and, similar to the contact projections 47, extends along the inserting direction MD of the support 42. The squeezable projection 55 is between the contact projections 47F, 47R with respect to the inserting direction MD of the support 42 so that the projections 47, 55 do not overlap along the mounting direction MD.

Figure 7:
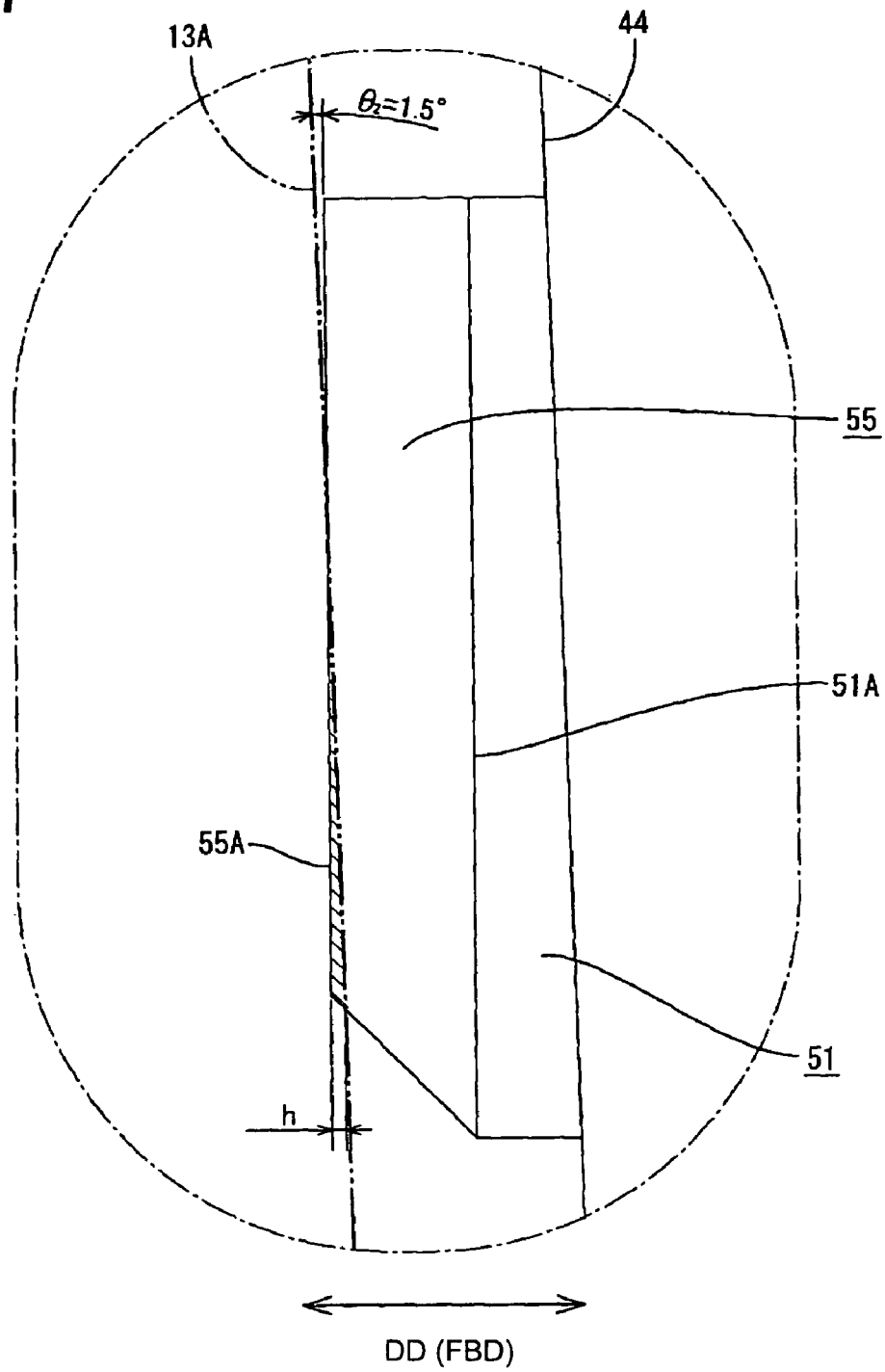
FIG. 7 shows a squeezable projection that has been squeezed.

Each squeezable projection 55 is formed on a flat plate-shaped seat 51 and has a substantially pointed cross-section tapered toward the corresponding wall surface 13A. As described above, the front temporary holding surface 44 of each support 42 is inclined in conformity with the wall surface 13A of the rail 13. As shown in FIGS. 6 and 7, the inclination of an upper surface 51A (rear portion as seen along the mounting direction MD) of the seat 51 and that of a tip 55A of the squeezable projection 55 do not conform to that of the wall surface 13A, and both the upper surface 51A and the tip 55A extend substantially vertically along the mounting direction MD.

With the waiting-side connector 20 mounted into the casing 10, the front end (bottom end in FIG. 7) of the tip 55A with respect to inserting direction MD can interfere with the wall surface 13A in depth direction DD and along the forward and backward direction FBD. Accordingly, when the supporting pieces 42 are inserted in the inserting direction MD into the supporting grooves 15, the front ends of the tips 55A contact the wall surfaces 13A as the insertion progresses, and the contacts (hatched portion in FIG. 7) are obliquely squeezed and deformed along the wall surfaces 13A towards or at a final stage of the insertion. In this embodiment, an angle θ2 between the wall surfaces 13A and the tips 55A of the squeezable projections 55 is set at between about 3° and 0°, preferably at less than about 2°, preferably at about 1.5°.

When the assembling is completely by pressing the supports 42 into the supporting grooves 15, the waiting-side connector 20 is held temporarily in the casing 10 so as not to shake. In this embodiment, temporary holding means prevent the waiting-side connector 20 from coming out of the casing 10 until the casing 10 is closed by the lid. Specifically, there is required a holding force of such a degree that the waiting-side connector 20 does not come out even if the casing 10 is shaken or the opening is faced down so that gravity can act on the waiting side-connector 20.

The height of the interference of the squeezable projection 55 and the wall surface 13A, i.e. squeezed height h along the depth direction DD (see FIG. 7) of the squeezable projection 55 in the temporarily held state, is calculated in view of the insertability of the supports 42 into the supporting grooves 15 and the holding force.

The squeezed height h is calculated in accordance with equations to be described next and tests using simulated models.

Figure 9:
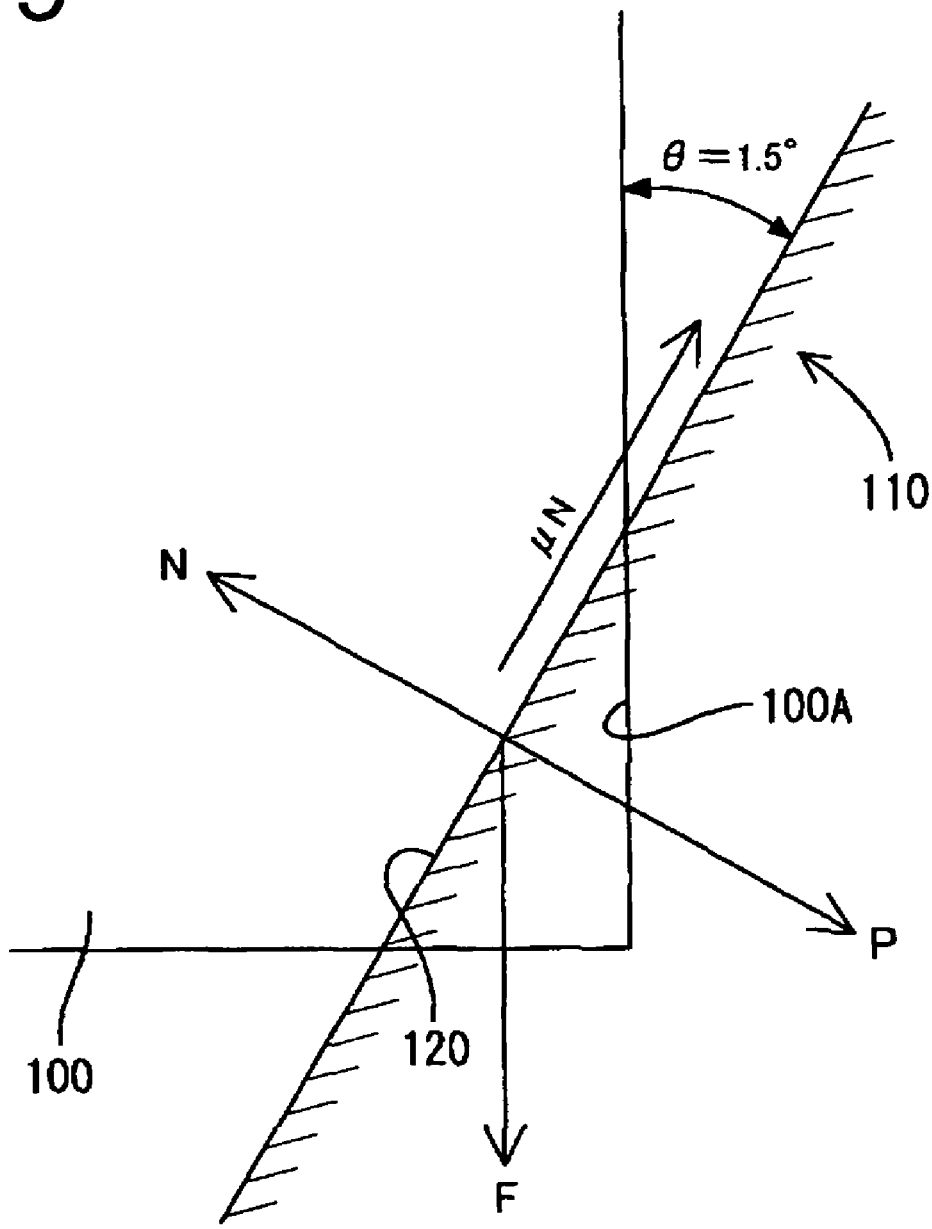
FIG. 9 shows the balancing of forces on a squeezed surface.

FIG. 9 diagrammatically shows a vertical section in a state where the squeezable projection 55 is squeezed. Identified by 100 is the squeezable projection (100A is a shape before being squeezed), by 110 the wall surface 13A of the rail 13 and by 120 a squeezed surface.

At this time, in consideration of the balancing of forces on the squeezed surface 120, an inserting force F first acts down in the mounting direction MD. Subsequently, a reaction force P of the squeezable projection 100 acts as a force acting on the wall surface 110 from the squeezable projection 100. This is a force created when the squeezable projection 100 is pushed by the wall surface 110, and acts in a direction substantially normal to the squeezed surface 120. Further, a vertical resistance N (or resistance along the inserting or mounting direction MD) acts as a force acting on the squeezable projection 100 from the wall surface 110. This also acts in a direction normal to the squeezed surface 120. Accordingly, if p denotes a friction coefficient of the squeezed surface 120, equation (1) is obtained by the vertical balancing of the respective forces F, P, and N and equation (2) is obtained by the horizontal balancing thereof.

$$F+P\times\sin\theta=\mu\times N\times\cos\theta+N\times\sin\theta \quad (1)$$

$$N\times\cos\theta=\mu\times N\times\sin\theta+P\times\cos\theta \quad (2)$$

By substituting either one of the equations (1) and (2) into the other thereof, equation (3) representing a correlation of the inserting force F and the reaction force P can be obtained.

$$F=(\mu/(\cos\theta-\sin\theta))\times P \quad (3)$$

Subsequently, a squeezing test for obtaining a correlation characteristic of the squeezed height h and the reaction force P and a tensile test for obtaining a correlation characteristic of the friction coefficient $\mu$ and the reaction force P are described.

Figure 10:
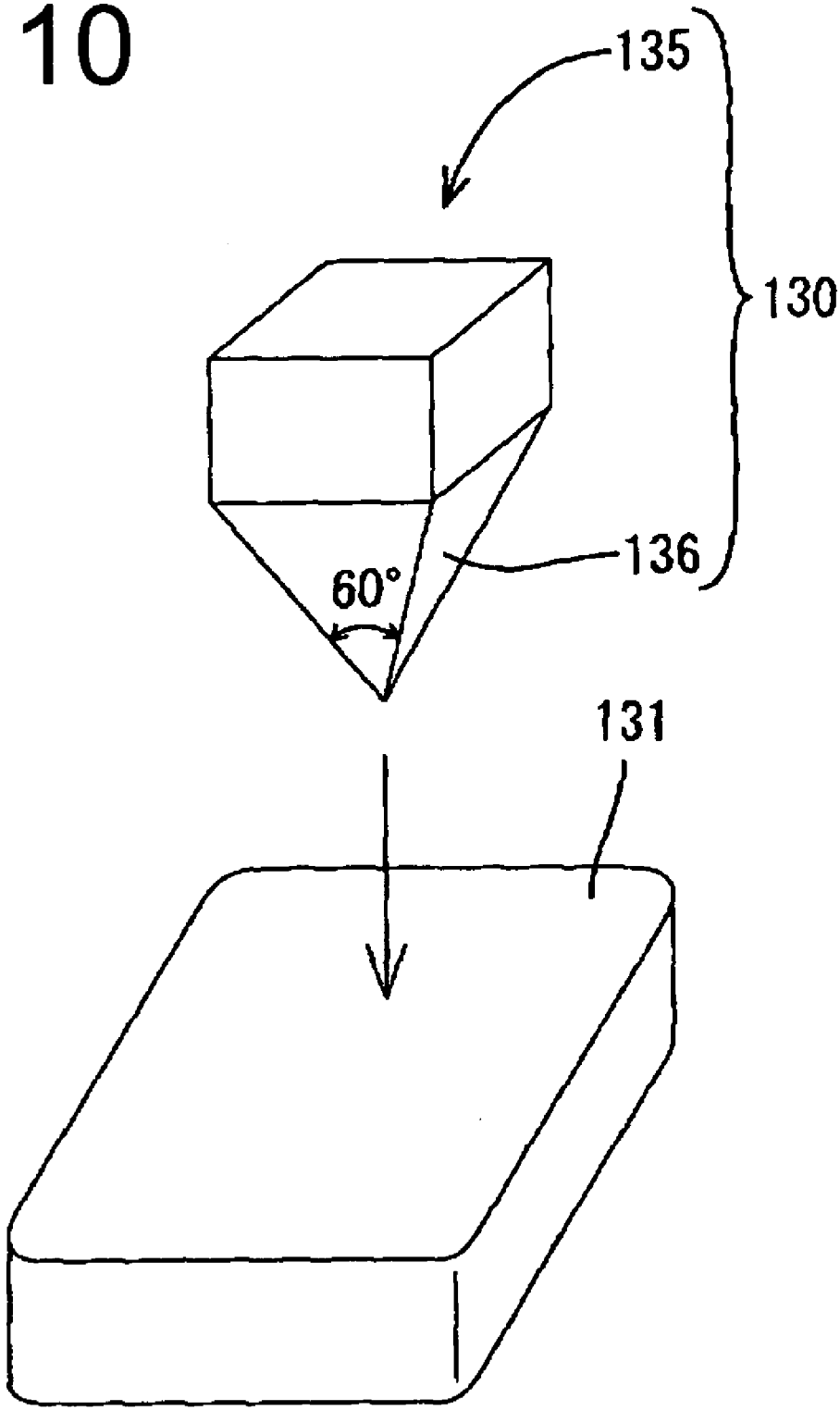
FIG. 10 is a perspective view of a simulated reaction-force measurement model.

The squeezing test is conducted using a simulated reaction-force measurement model 130 comprised of a metal plate 131 made e.g. of an aluminum (preferably same material as the casing 10) and a resin piece 135 made of a polybutylene terephthalate (preferably same material as the waiting-side connector 20). As shown in FIG. 10, a leading end (portion to be squeezed) of the resin piece 135 has a substantially pyramidal shape (FIG. 10).

Figure 8:
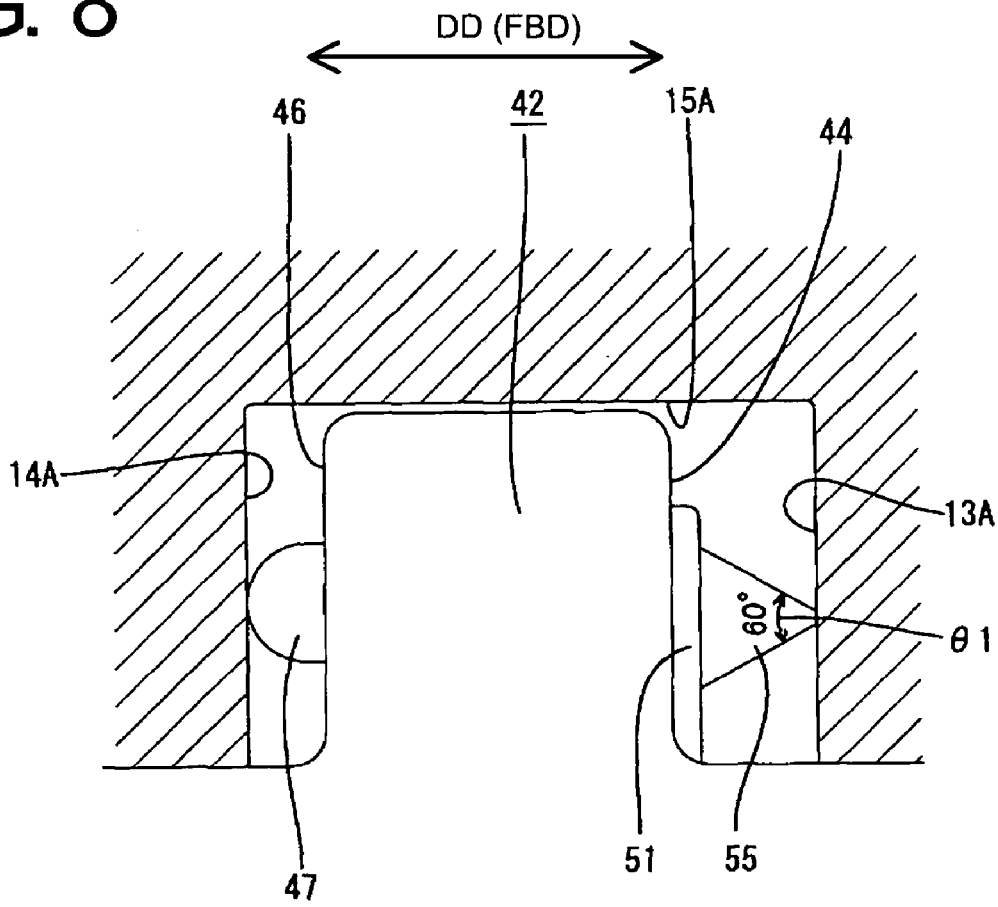
FIG. 8 is a horizontal section showing a state where the squeezable projection is squeezed.

A pyramidal portion 136 is shaped so that a vertical angle between two substantially opposite faces as measured at the leading end of the pyramid is between about 50° and about 70°, preferably about 60°. This is because the squeezable projection 55 has a substantially triangular cross section in this embodiment and a vertical angle θ1 of this cross section is between about 50° and about 70°, preferably about 60° (FIG. 8). Accordingly, if the vertical angle of one side is set at about 60°, a squeezed state similar to the one when the squeezable projection 55 is actually squeezed can be reproduced in the test.

Figure 11:
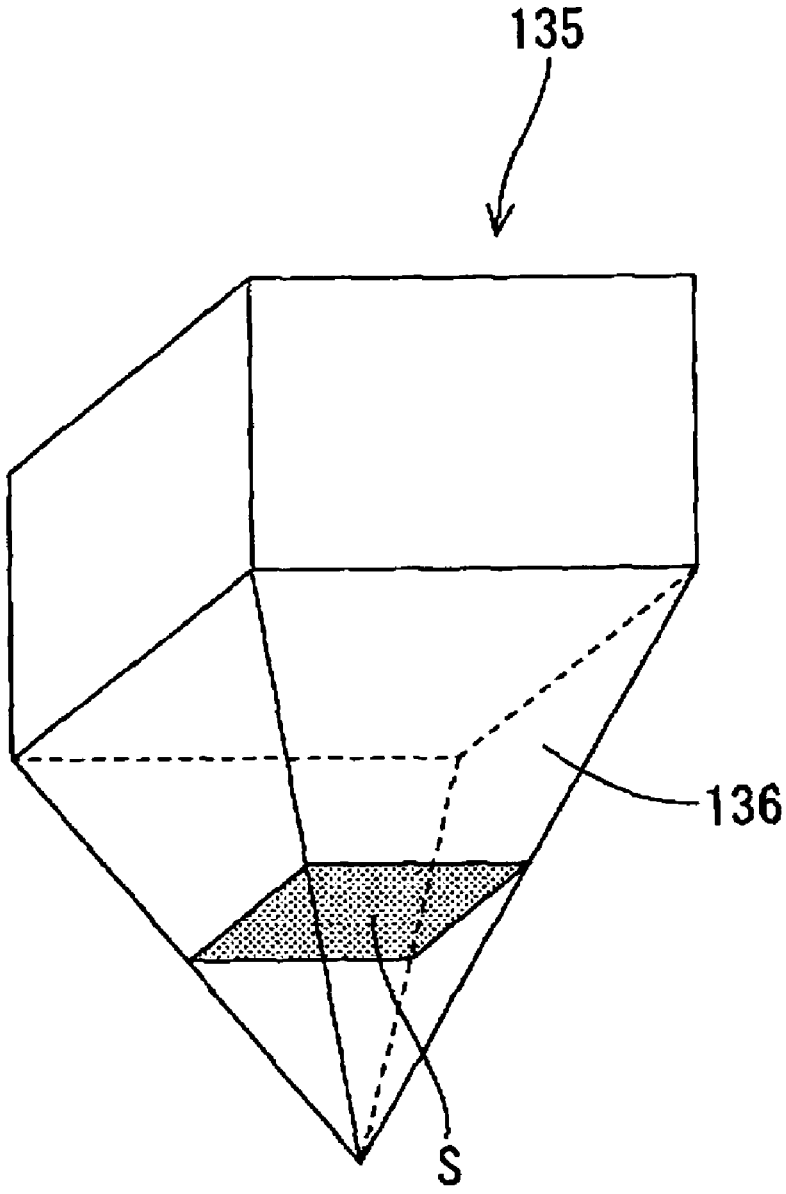
FIG. 11 is a perspective view showing a squeezed area and a squeezed height.
Figure 12A:
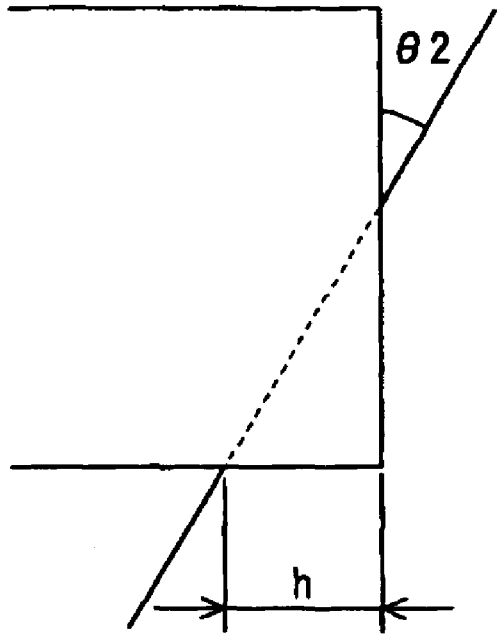
FIGS. 12(A) and 12(B) are diagrams showing the squeezed area and the squeezed height.
Figure 12B:
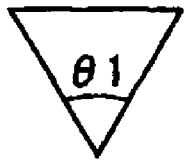
Figure 12B:
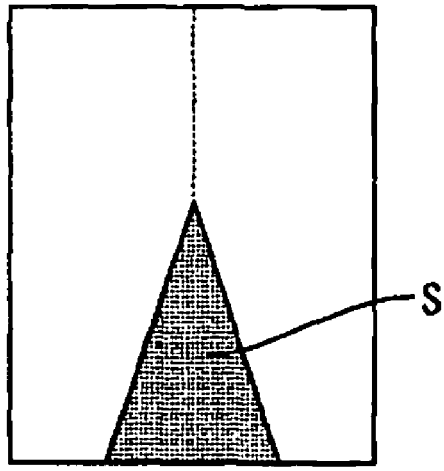

This test is conducted by setting the resin piece 135 above the metal plate 131 with the tip of the pyramidal portion 136 faced down, lowering the resin piece 135 in this state along a center axis of the pyramidal portion 136 to bring the tip of the pyramidal portion 136 into contact with the metal plate 131 and squeeze it, and measuring a squeezed area S (see FIG. 11). In this way, a pressing load W exerted on the resin piece 135 and a test data of the squeezed area S corresponding to this pressing load W can be obtained. Thus, a correlation characteristic (equation (4)-1) of the squeezed area S and the pressing force W can be obtained by the data processing of these experiment data by a computing machine.

$$W=-0.388(S\times S)+9.1\times S \quad (4)\text{-}1$$

In the above formula W is given in N and S is given in mm.

On the other hand, according to the knowledge of the inventors, the squeezed area S and the intensity of the corresponding reaction force P, and the pressing force W and the size of the corresponding squeezed area S have both correspondence relationships. Intensity P1 of the reaction force of the resin piece 135 when the squeezed area is S1 can be thought to be a pressing force W1 required to squeeze the resin piece 135 by the area S1. In other words, it can be assumed that P=W.

Accordingly, a correlation characteristic of the squeezed area S and the reaction force P (equation (4)-2) can be obtained by substituting P for W of equation (4)-1.

$$P=-0.388(S\times S)+9.1\times S \quad (4)\text{-}2$$

Figure 13A:
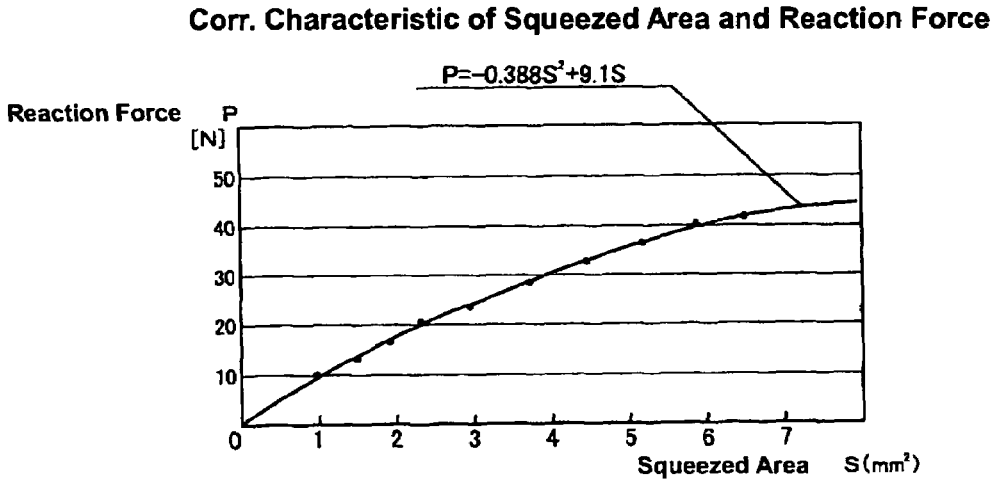
FIGS. 13(A) and 13(B) are graphs showing a correlation characteristic of the squeezed area and a reaction force and a correlation characteristic of the squeezed height and the squeezed area.
Figure 13B:
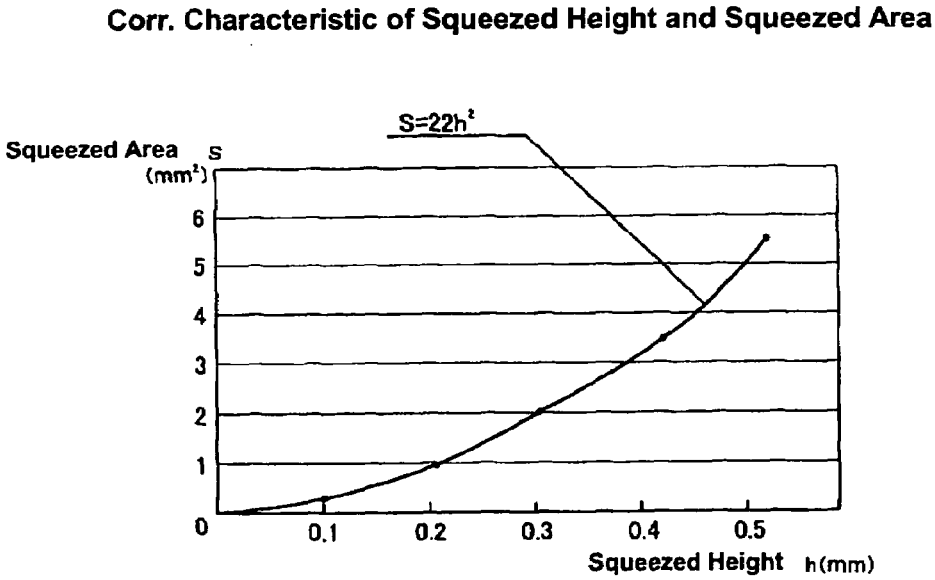

FIG. 13(A) is a graph showing the correlation characteristic of the squeezed area S and the reaction force P.

On the other hand, the relationship between the squeezed height h and the squeezed area S of the squeezable projection 55 can be calculated by a computing machine. Specifically, in this embodiment, the vertical angle θ1 of the squeezable projection 55 is about 60° as described above and the angle θ2 between the squeezable projection 55 and the wall surface 13A of the rail piece 13 is about 1.5°. Thus, the cross section of the squeezable projection 55 and an angle of inclination of the squeezed surface can be specified if these conditions are determined. Therefore, the squeezed area S corresponding to the squeezed height h can be obtained by equation (5).

$$S=22(h\times h) \quad (5)$$

Figure 16A:
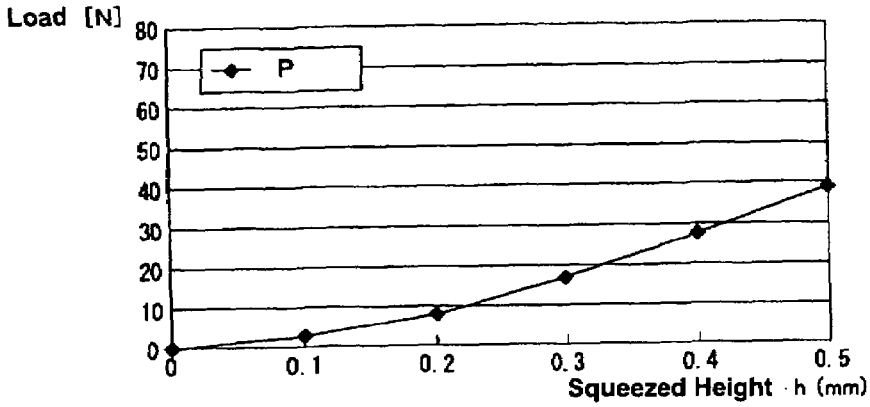
FIGS. 16(A) and 16(B) are graphs showing a correlation characteristic of the squeezed height and the reaction force and a correlation characteristic of the squeezed height and an inserting force.

Accordingly, a correlation characteristic of the squeezed height h and the reaction force P can be obtained by substituting equation (5) into equation (4)-2. FIG. 16A is a graph showing the correlation characteristic of the squeezed height h and the reaction force P.

Next, the tensile test for obtaining the correlation characteristic of the friction coefficient $\mu$ and the reaction force P is described. It should be noted that the friction coefficient $\mu$ is generally peculiar to a material. For example, in the case of considering a motion of a movable portion on the upper surface (sliding surface) of a fixed portion, the friction coefficient $\mu$ is specified by the materials of both portions and does not depend on a force acting on the sliding surface from the movable portion to the fixed portion, i.e. the intensity of the reaction force P unless the materials are changed. However, if the sliding surface has fine unevenness, the friction coefficient $\mu$ may change depending on the intensity of the reaction force.

Figure 14:
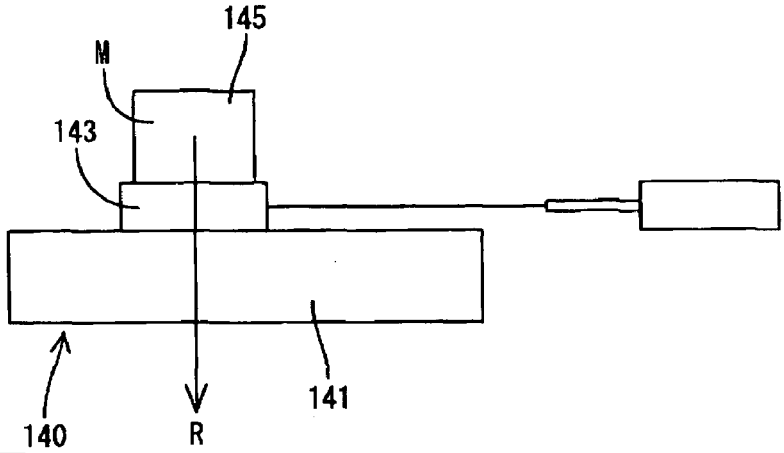
FIG. 14 is a side view of a simulated friction-coefficient measurement model.

The tensile test is conducted using a simulated friction-coefficient measurement model 140 comprised of a metal mount 141 made e.g. of an aluminum (preferably same material as the casing 10) and a resin piece 143 made e.g. of a polybutylene terephthalate (preferably same material as the waiting-side connector 20). As shown in FIG. 14, the resin piece 143 used is in the form of a substantially flat plate. In this test, one end of the resin piece 143 is pulled with a weight 145 having a mass M placed on the resin piece 143. Tests are conducted while the mass M of the weight is changed, and tensile loads at the respective masses M are measured.

If it is assumed that Y, R denote a measured tensile load and a force vertically acting on the metal mount 141 from the resin piece 143, the friction coefficient $\mu$ is calculated by equation (6) below.

$$\mu=Y/R \quad (6)$$

A correlation characteristic of a force acting in normal direction and the friction coefficient (equation (7)) can be obtained by the data processing of the obtained friction coefficients $\mu$ by means of a computing machine.

$$\mu=0.0001(R\times R)+0.082\times R+0.171 \quad (7)\text{-}1$$

On the other hand, this force R is a force vertically acting on the metal mount 141 from the resin piece 143 as described above, and the reaction force P is also a force vertically acting on the wall surface 13A from the squeezable projection 55. In other words, the above force R and the reaction force P both act on the fixed side from the movable side in directions normal to the moving direction of the movable side in the case of considering the action of the forces on the squeezed surface (sliding surface on which the resin member is moved). Thus, the correlation characteristic of the above vertically acting force R and the friction coefficient $\mu$ can be assumed to be a correlation characteristic of the reaction force and the friction coefficient (equation (7)-2).

$$\mu=0.0001(P\times P)+0.082\times P+0.171 \quad (7)\text{-}2$$

Figure 15:
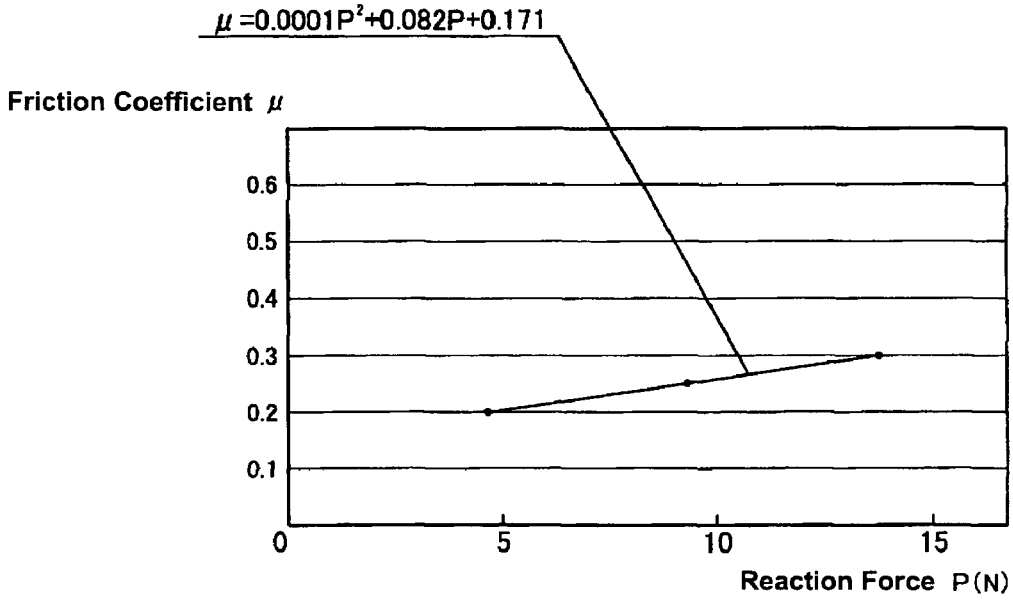
FIG. 15 is a graph showing a correlation characteristic of the friction coefficient and the reaction force.

The friction coefficients $\mu$ corresponding to the intensities of the respective reaction forces P and calculated by equation (7)-2 correspond to a preferred value "$\mu$p". FIG. 15 is a graph showing the correlation characteristic of the reaction force P and the friction coefficient $\mu$.

Next, a correlation characteristic of the squeezed height and the inserting force is calculated in accordance with the above equation (3), the correlation characteristic of the squeezed height and the reaction force (equations (4)-2, (5)) and the correlation characteristic of the reaction force and the correlation characteristic ((7)-2). For example, in order to calculate an inserting force Fo in the case of a squeezed height ho, a reaction force Po and a friction coefficient $\mu$o are first calculated.

The reaction force Po is calculated by substituting ho into equation (5) to calculate So and substituting the obtained So into equation (4)-2.

In order to calculate the friction coefficient $\mu o$, the obtained Po may be substituted into equation (7)-2. After $\mu o$ and Po are calculated, these values are substituted into equation (3) to calculate the inserting force Fo corresponding to the squeezed height ho.

On the other hand, since a pair of supporting pieces 42 preferably are provided on the lateral (left and right) sides of the waiting-side connector 20 in this embodiment, an inserting force Go for inserting the waiting-side connector 20 into the casing 20 needs to be twice the inserting force Fo.

The inserting force Fo is calculated based on the correlation characteristics obtained from the test data. Any of these correlation characteristics is derived from average values of the test data. Accordingly, the obtained inserting force Fo is an average value of the calculated inserting forces. However, since the inserting force varies, in reality, due to a variation of part precision and the like, the inserting force G for inserting the waiting-side connector 20 into the casing 10 needs to be calculated as a maximum value instead of as an average value. In this embodiment, the inserting force F is divided by 0.71 for the conversion (correction) of the average value into the maximum value. Therefore, the inserting force G for inserting the waiting-side connector 20 into the casing 10 can be obtained by equation (8) below.

$$G=2\times F\div 0.71 \quad (8)$$

The intensities of the inserting forces G corresponding to the respective squeezed heights h are calculated in this way. Thus, the correlation characteristic of the squeezed height and the inserting force can be obtained (see FIG. 16(B). It should be noted that this correlation characteristic of the squeezed height and the inserting force corresponds to a correlation characteristic of the squeezed amount and the inserting force according to the present invention.

In general, if there is an operation process where an operator needs a force of about 40 [N] or larger for an assembling operation in a production line or the like, it is difficult to continue the operation in this operation process for several hours, whereby operation efficiency is reduced. Accordingly, in this embodiment, an upper limit value of the inserting force for the waiting-side connector 20 is set at about 40 [N].

Figure 16B:
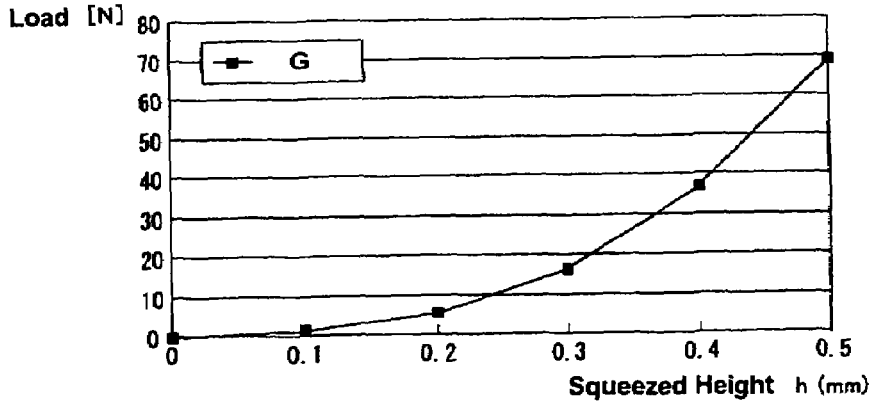
Figure 17:
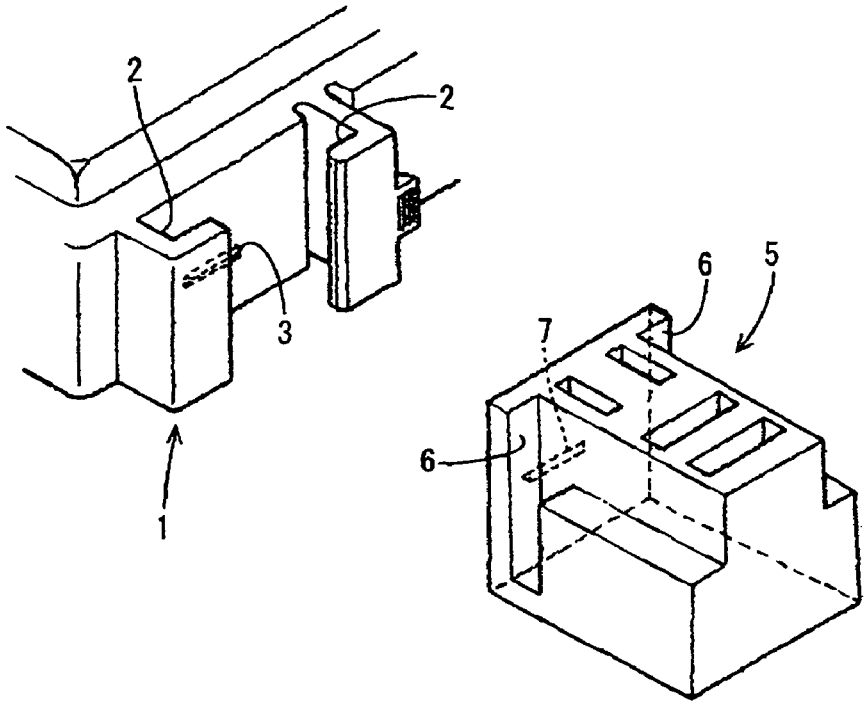
FIG. 17 PRIOR ART
FIG. 17 is a perspective view of a prior art supporting construction.

Thus, an upper limit value of the squeezed height h is calculated based on the correlation characteristic of the squeezed height and the inserting force shown in FIG. 16(B). Thus, the squeezed height h for ensuring an inserting force of about 40 [N] or smaller needs to be about 0.4 [mm] or shorter.

On the other hand, a lower limit value of the squeezed height h is calculated based on a holding force for holding the waiting-side connector 20 in the casing 10 in the temporarily held state. Since the waiting-side connector 20 is held in the casing 10 with a stronger holding force if the reaction force P increases, the reaction force P can be regarded as a holding force. On the other hand, it is sufficient for the intensity of this holding force to temporarily hold the waiting-side connector 20 in the casing 10 at least until the lid member is mounted. Accordingly, if the reaction force P of the squeezable projection 55 against the wall surface 13A is set, for example, at about 10 N or larger per location, a lower limit value of the squeezed height h can be calculated based on the correlation characteristic of the squeezed height and the reaction force shown in FIG. 16(A). In short, the squeezed height h needs to be about 0.25 mm or longer in order to ensure the reaction force P of about 10 N or larger.

Accordingly, a permissible range of the squeezed height h may be set between about 0.25 [mm] and about 0.4 [mm]. If this range is set between about 0.3 [mm] and about 0.35 [mm], it is more desirable since there are some margins for the inserting force G and the holding force.

According to a conventional practice, a designer has been set the squeezed height h based on his experience. However, the actual verification of prototypes proves it difficult to simultaneously meet both requirements of the inserting force G and the holding force. A required holding force may not be obtained even if the inserting force lies within the set range, or the inserting force G may be too large even if the required holding force can be obtained. In such a case, the designer is forced to redesign. Since the permissible range of the squeezed height h is calculated in accordance with the force-balancing equation and the correlation characteristics based on the experiments according to this embodiment, redesigning can be prevented.

Further, since the friction coefficients $\mu$ corresponding to the respective reaction forces P can be calculated or determined by conducting the tensile tests beforehand, an error in the inserting force due to the variation of the friction coefficient resulting from the fine unevenness of the wall surface 13A can be excluded.

Calculations are made, assuming that the angle $\theta$1 of the squeezable projection 55 is about 60° and the angle $\theta$2 between the squeezable projection 55 and the wall surface 13A is about 1.5° in this embodiment. In the case of calculating the squeezed height h when these angles $\theta$1, $\theta$2 are changed, the permissible range of the squeezed height h can be calculated using the force-balancing equation and correlation characteristics obtained from the squeezing tests and the tensile tests as they are if the correlation characteristic of the squeezed height h and the squeezed area S (corresponding to the one defined by equation (5)) at the changed angles is newly calculated.

The invention is not limited to the above described and illustrated embodiment. For example, the following embodiment is also embraced by the technical scope of the present invention as defined by the claims. Beside the following embodiment, various changes can be made without departing from the scope and spirit of the present invention as defined by the claims.

Although the friction coefficient $\mu$ is calculated for each reaction force P and the inserting force is calculated using it in the foregoing embodiment, the inserting force may be calculated while the friction coefficient $\mu$ is set at a constant value independent of the intensity of the reaction force.

What is claimed is:

1. A supporting construction for supporting a waiting-side connector with respect to a fixing member, comprising:

at least one supporting groove formed in either one of the fixing member and the waiting-side connector;

at least one support on the other of the fixing member and the waiting-side connector, engageable with the supporting groove and adapted to support the waiting-side connector with respect to the fixing member; and at least one engagement projection on one of an outer wall surface of the support and an inner wall surface of the supporting groove and spaced from the other of the outer wall surface of the support and an inner wall surface of the supporting groove at an initial stage of insertion of the support into the supporting groove and to closely engage the support with the supporting groove while leaving substantially no clearance at a final stage of the insertion, wherein the engagement protection comprises a squeezable protection to be squeezed between the support and the supporting groove.

2. The supporting construction of claim 1, wherein spacing between the wall surfaces of the supporting groove and the support is narrowed gradually as the support is inserted into the supporting groove, and the engagement projection has a cross section gradually narrowed toward one of the outer wall surface of the support and the inner wall surface of the supporting groove.

3. The supporting construction of claim 1, wherein the supporting groove is in the fixing member and the support is on the waiting-side connector, and the engagement projections are formed at least at three positions of the wall surfaces of the support for contacting the inner wall surfaces of the supporting groove.

4. The supporting construction of claim 1, wherein a projecting amount along a transverse direction of the supporting piece from a side surface is substantially constant at a rear end of the supporting piece with respect to an mounting direction, but gradually decreases from an intermediate position to a leading end of the supporting piece with respect to the mounting direction.

5. The supporting construction of claim 1, wherein the spacing of the supporting groove is narrowed gradually or in steps in the mounting direction.

6. The supporting construction of claim 1, wherein the squeezable projection has such a substantially triangular cross section tapered toward the inner wall of the groove portion to form an angle of between about 50° and 70°, preferably of about 60°, and a squeezed height or a squeezed amount of a front end of the squeezable projection with respect to the inserting direction lies within a range of about 0.3 mm to about 0.35 mm.

7. A squeezable supporting construction for temporarily holding a resin fixable member on a metal fixing member by bringing a leading-end of at least one squeezable projection on at least one supporting piece on the fixable member into contact with an inner wall of a groove at an angle of less than about 3° to an mounting direction to squeeze the squeezable projection in the process of inserting the supporting piece on the fixable member into the groove in the fixing member, wherein the squeezable projection is tapered toward the inner wall of the groove to form an angle of between about 50° and 70°, and a squeezed height of a front end of the squeezable projection with respect to the inserting direction lies within a range of about 0.3 mm to about 0.35 mm.

8. A squeezed amount calculating method for calculating a squeezed amount of a squeezable projection upon temporarily holding a resin fixable member onto a metal fixing member by bringing a leading-end of the squeezable projection on a supporting piece into contact with an inner wall of a groove at an angle θ° to an mounting direction to squeeze the squeezable projection in the process of inserting the supporting piece on the fixable member into the groove in the fixing member, the method employing the equation:

$$F+P\times\sin\theta=\mu\times N\times\cos\theta+N\times\sin\theta \quad (1)$$

$$N\times\cos\theta=\mu\times N\times\sin\theta+P\times\cos\theta \quad (2)$$

$$F=(\mu/(\cos\theta-\sin\theta))\times P \quad (3),$$

where F denotes an inserting force at the time of inserting the supporting piece into the groove portion, P denotes a reaction force acting from the squeezable projection to the inner wall of the groove portion on a squeezed surface of the squeezable projection squeezed by the inner wall, and N denotes a vertical resistance of the inner wall of the groove portion on the squeezed surface, the method comprising:

calculating equation defining a correlation of the inserting force F and the reaction force P in accordance with equation defining the vertical balancing of the forces F, P, N and equation defining the horizontal balancing thereof by use of a simulated reaction-force measurement model comprised of a metallic member made of the same material as the fixing member and a resin member made of the same material as the fixable member;

conducting a squeezing test for squeezing the resin member by pressing the resin member against the metallic member;

obtaining a correlation characteristic of the squeezed amount and the reaction force based on the obtained test data;

calculating a correlation characteristic of the squeezed amount and the inserting force based on the correlation characteristic of the squeezed amount and the reaction force and the equation;

calculating a squeezed amount A corresponding to a lower limit value of the reaction force from the correlation characteristic of the squeezed amount and the reaction force, assuming the intensity of a holding force required to hold the supporting piece in the groove portion upon temporarily holding the fixable member onto the fixing member as the lower limit value of the reaction force; and in the case of setting the inserting force F within a specified load range, calculating a squeezed amount B corresponding to an upper limit value of the inserting force F from the correlation characteristic of the squeezed amount and the inserting force and calculating a permissible range of the squeezed amount by setting these squeezable amounts A, B as the lower and upper limit values of the squeezed amount.

9. The squeezed amount calculating method of claim 8, further comprising the steps of:

with the use of a simulated friction-coefficient measurement model comprised of a metallic member made of the same material as the fixing member and a resin member made of the same material as the fixable member, conducting tensile tests by pulling one end of the resin member on the metallic member to slide the resin member, measuring a tensile load in each tensile test by changing a mass M of the resin member to various values, and calculating a correlation characteristic of a force acting in a direction substantially normal to a moving surface of the metallic member on which the resin member is moved and a friction coefficient in accordance with equation if Y, R respectively denote an obtained measured load and a force acting from the resin member to the metallic member in the normal direction, $$\mu=Y/R \quad (6), \text{ and}$$

calculating a friction coefficient $\mu p$ corresponding to the intensity of the reaction force P from the correlation characteristic of the force acting in the normal direction and the friction coefficient, assuming that the reaction force P is the force R acting in the normal direction, and calculating the inserting force F by substituting the obtained friction coefficient $\mu p$ and the reaction force into the equation.

* * * * *